US007653333B2

(12) United States Patent
Kawai

(10) Patent No.: US 7,653,333 B2
(45) Date of Patent: Jan. 26, 2010

(54) PADDLE, DEVELOPING DEVICE AND IMAGE FORMING APPARATUS

(75) Inventor: Hideaki Kawai, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 502 days.

(21) Appl. No.: 11/620,863

(22) Filed: Jan. 8, 2007

(65) Prior Publication Data

US 2007/0189809 A1 Aug. 16, 2007

(30) Foreign Application Priority Data

Feb. 10, 2006 (JP) ..... 2006-033702

(51) Int. Cl.
*G03G 15/08* (2006.01)

(52) U.S. Cl. ..... 399/254; 399/256

(58) Field of Classification Search ..... 399/254, 399/256

See application file for complete search history.

(56) References Cited

U.S. PATENT DOCUMENTS 5,146,277 A * 9/1992 Fox et al. ..... 399/254

6,585,406 B2 * 7/2003 Toepper et al. ..... 399/256

FOREIGN PATENT DOCUMENTS

| | | | |
|---|---|---|---|
| JP | 62-91656 | U | 6/1987 |
| JP | 04-174471 | A | 6/1992 |
| JP | 07-097121 | A | 4/1995 |
| JP | 2002-040768 | A | 2/2002 |
| JP | 2002-040810 | A | 2/2002 |
| JP | 2005-091774 | A | 4/2005 |

OTHER PUBLICATIONS

Official Communication issued in corresponding Japanese Patent Application No. 2006-033702, mailed on Aug. 13, 2009.

* cited by examiner

*Primary Examiner*—William J Royer
(74) *Attorney, Agent, or Firm*—Keating & Bennett, LLP

(57) ABSTRACT

A paddle includes a plurality of axially divided components that are connected together, each component including axially extending blades, wherein the blades overlap with blades provided on a component adjacent to the corresponding component in the circumferential direction.

24 Claims, 12 Drawing Sheets

PADDLE, DEVELOPING DEVICE AND IMAGE FORMING APPARATUS

BACKGROUND OF THE INVENTION

1. Field of the Invention

The present invention relates to an image forming apparatus for use in, for example, a copying machine, a printer, a facsimile and the like. More specifically, the present invention relates to an image forming apparatus provided with a developing device, wherein the developing device has a paddle and the paddle supplies developer while agitating the same.

2. Description of the Related Art

An image forming apparatus used for a copying machine, a printer, a facsimile, and a multi-function machine which includes at least two of these functions selectively exposes the surface of a uniformly charged photoreceptor drum according to image information to form a latent image, develops the formed electrostatic latent image to form a toner image, and transfers the toner image to printing paper to print an image. Subsequently, the toner image which is not yet fixed is fixed on the printing paper. A developer is stored in a developer container, and a paddle provided with blades extending in the radial direction supplies the developer to a developing sleeve while agitating the same to cause the developing sleeve to hold the developer. Then, by supplying the developer from the developing sleeve having the developer held thereon to the photoreceptor drum, a toner image, which is based on the electrostatic latent image, is formed on the surface of the photoreceptor drum.

The paddle is an elongated member since it requires at least a length equal to the length of the developing sleeve which corresponds to the width of the printing paper. It is difficult to obtain such an elongated paddle with a high degree of accuracy by metal machining, and the machining cost is expensive. Injection molding of the elongated paddle with resin or plastic requires a high die cost, and it is also difficult to eliminate molding distortion generated in the axial (longitudinal) direction.

Therefore, as shown in FIG. 11 and FIG. 12, there is known a paddle 900 which is axially divided into a plurality of components 901 and each component 901 is individually formed by injection molding (see, for example, Unexamined Japanese Patent Publication No. 2002-40768). The components 901 each include blades 902 extending between both end surfaces in the axial direction. For example, FIGS. 11 and 12 disclose an assembly of a paddle including discontinuous blades extending in the radial direction and shifted by 30° and a helical blade made by connecting the axially divided plurality of components.

However, as shown in FIG. 12, in the paddle 900 obtained by connecting the axially divided plurality of components 901, since there is a limit in dimensional accuracy of the injection molding or the like, spaces s are generated between the blades 902 provided on each component 901 of the paddle 900 and blades 902 adjacent thereto. Such spaces s degrade the accuracy of supplying the toner by the paddle 900, and cause defective image formation. For example, since the developer is not agitated at positions where the spaces s exist, the developer conglomerates and causes defective image formation. Since the developer is not scraped up at the positions where the spaces s exist and thus is not supplied to the developing sleeve, there may be portions on the surface of the developing sleeve where the developer is not supplied. In such a case, there is a problem such that the developer is not supplied to a portion of the surface of the photoreceptor drum which opposes the developing sleeve. Hence, the toner is not adhered to the corresponding portion and hence an image with a void is formed on the printing paper, so that defective image formation results. Since there are the spaces s between the blades 902 of the paddle 900, if there are portions where a sufficient required amount of the developer is not held on the surface of the developing sleeve, there may be a case in which an image having a density less than that of the desired level is formed on the printing paper, so that defective image formation results.

SUMMARY OF THE INVENTION

In order to overcome the problems described above, preferred embodiments of the present invention prevent an occurrence of the defective image formation due to spaces generated between the blades of the plurality of components divided in the axial direction of the elongated paddle.

An image forming apparatus according to a first preferred embodiment includes a developing section having a developer device that supplies developer to a photoreceptor, a developer container for storing the developer, and a paddle supply member that is rotatably supported in the developer container and arranged to supply the developer stored in the developer container to the developer device while agitating the same, wherein the paddle supply member is defined by a plurality of axially divided components that are connected to each other, wherein each component includes axially extending blades, and the blades overlap with blades provided on a component adjacent to the corresponding component in the circumferential direction.

According to the image forming apparatus of the present preferred embodiment, since the paddle supply member for supplying the developer to the developer device while agitating the same is formed by connecting the axially divided plurality of components, and the component includes blades extending in the axial direction, spaces are generated in the axial direction between the blades of the connected components. However, since the blades provided on the component are overlapped in the circumferential direction with the blades provided on the components adjacent to the corresponding component, the spaces generated between the blades of the connected components are shifted from each other in the axial direction. Therefore, the paddle supply member can agitate and desirably supply the developer along the entire axial direction by the rotation of the paddle supply member since at least one of the blades exists in the circumferential direction, so that generation of the defective image formation can be prevented.

In the image forming apparatus according to a preferred embodiment of the present invention, the component is provided with blades extending in the radial direction, and the blades of the components adjacent to each other in the circumferential direction are axially shifted in position.

According to the image forming apparatus of this preferred embodiment, since the components include the blades extending in the radial direction, and the blades of the component adjacent in the circumferential direction are axially shifted in position, the paddle supply member can agitate and further desirably supply the developer, and occurrence of the defective image formation can further be prevented.

In the image forming apparatus according to a preferred embodiment of the present invention, the blades provided on the component and the blades provided on the component adjacent to the corresponding component are formed continuously.

According to the image forming apparatus in this preferred embodiment, since the blades provided on the component and the blades provided on the components adjacent to the corresponding component are formed continuously, an elongated paddle supply member can be provided having long blades continuing in the axial direction to agitate and supply the developer, so that the occurrence of the defective image formation can further be prevented.

In the image forming apparatus in the present preferred embodiment of the present invention, the respective components preferably have the same shape.

According to the image forming apparatus of this preferred embodiment, since the respective components have the same shape, connection is achieved without considering the connecting order of the components, so that the manufacturing process of the paddle supply member can be simplified. In addition, since there is only one type of the component, the controlling process of the paddle supply member can be simplified.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
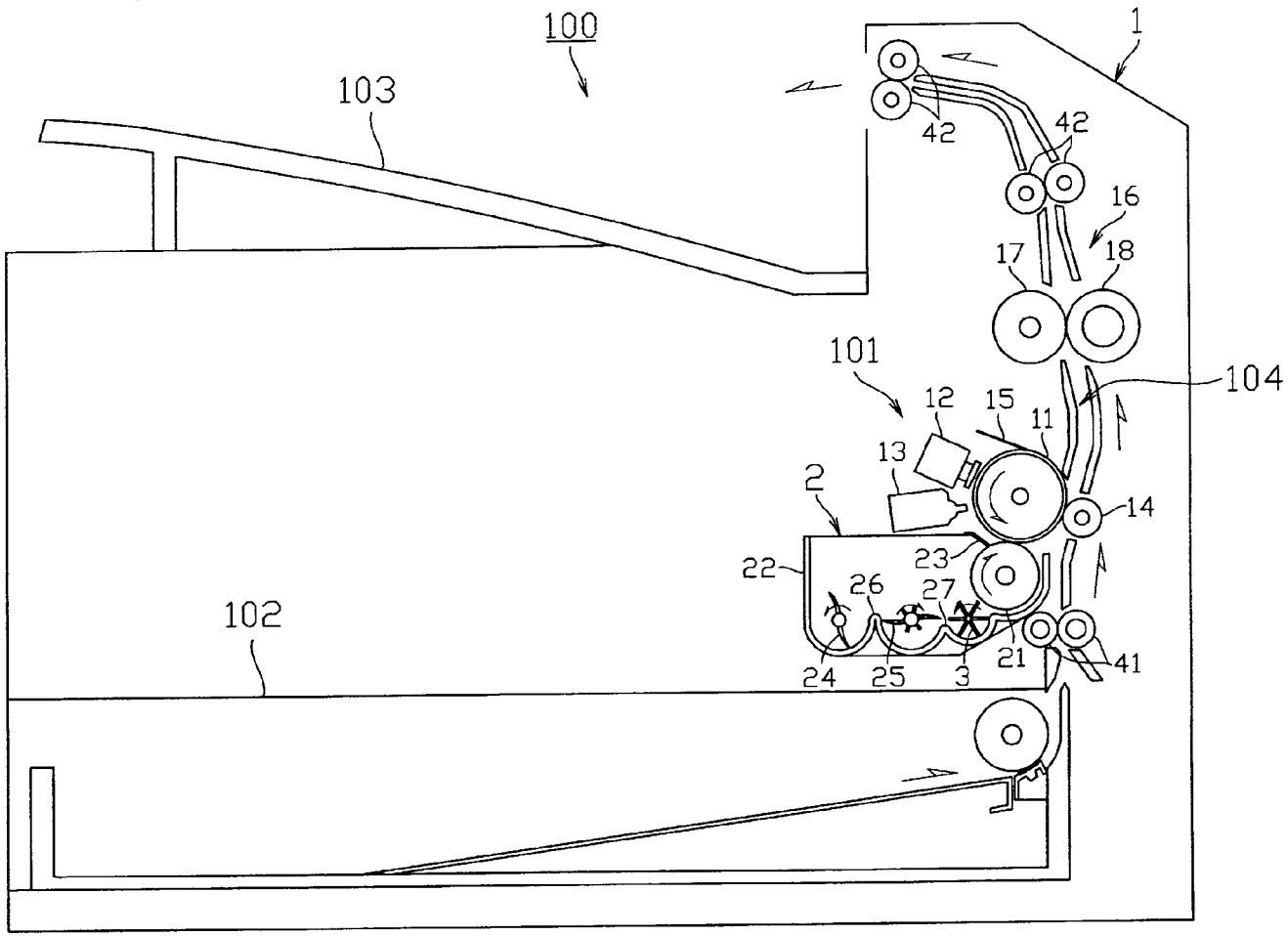
FIG. 1 is a schematic cross-sectional view showing an internal configuration of a copy/facsimile multi-function machine according to a preferred embodiment of the present invention.

As shown in FIG. 1, a copy/facsimile multi-function machine 100 provided with an image forming apparatus according to a preferred embodiment of the present invention includes a machine body 1, and a developing unit (developing section) 2 mounted to the machine body 1 which defines a portion of the image forming apparatus. The developing unit 2 includes a paddle (paddle supply member) 3 that agitates and supplies developer therein.

An image forming unit 101 including the developing unit 2 is disposed in the machine body 1. In addition, the machine body 1 is provided with a paper feed cassette 102 which supplies printing paper in sequence on a bottom portion thereof, and a paper discharge tray 103 above the image forming unit 101, respectively. Although not shown, the copy/facsimile multi-function machine 100 includes an image reading unit that functions as a flat-bed scanner and an operating panel for inputting instructions to read the image, start the printing job, and the like, above the paper discharge tray 103.

The paper feed cassette 102 can accommodate various sizes of printing paper, and is adapted to feed the printing paper to a carrier path 104 one-by-one. The carrier path 104 is provided with a pair of resist rollers 41, and the printing paper is carried to the image forming unit 101 with the alignment thereof adjusted. The carrier path 104 is provided with carrier rollers 42 as needed so that the printing paper on which an image is formed by the image forming unit 101 is carried, and discharged to the paper-discharge tray 103. In this manner, the printing paper is carried from the paper feed cassette 102 along the carrier path 104 to the image forming unit 101, then, is printed with images, characters, or the like by the image forming unit 101, and discharged to the paper discharge tray 103.

The image forming unit 101 includes a charging device 12 disposed around a photoreceptor drum (photoreceptor) 11, an LED head 13, the developing unit 2, a transfer roller 14, a cleaning blade 15, and a fixing device 16 disposed in the carrier path 104 on the downstream side of the photoreceptor drum 11. A configuration in which the photoreceptor drum 11, the charging device 12, the developing unit 2, and the cleaning blade 15 are stored integrally in a cartridge as a process unit may also be used.

The photoreceptor drum 11 is provided with a photoconductor film preferably formed of an organic photoreceptor on the surface thereof and is adapted to rotate at a predetermined speed by a driving source, not shown, and is charged to a constant voltage by the charging device 12. The charging device 12 is preferably a non-contact corona electrical charging system referred to as a scorotron electric charger and, although not shown in FIG. 1, includes a discharging wire disposed at the substantially center of a casing electrode which forms a half-space and a grid electrode arranged on the photoreceptor drum 11 side, so that corona discharge occurs by applying a predetermined voltage to the discharging wire, and the amount of ions generated by the corona discharge is controlled by the grid electrode. The charging device 12 may be another type of charging device which uses a contact-type roller charging system or the like instead of the non-contact corona electrical charging system.

The LED head 13 is preferably a so-called self-luminous printer head having an LED array including the same number of LEDs as the number of printing pixels for forming an image of light emitted by the LED array on the surface of the photoreceptor drum 11 by a SELFOC lens array. The LED head 13 selectively exposes a surface of the photoreceptor drum 11 on the basis of image information to form an electrostatic latent image on the surface. The surface of the photoreceptor drum 11 which is charged by the charging device 12 attenuates in surface potential by being exposed by the LED head 13, and is formed with an electrostatic latent image by the difference in potential from the unexposed portions. The image information of an original document read by an image reading unit which is, for example, a flat-bed scanner is transmitted as the image information to the LED head 13 in the form of an electric signal. The exposing device may be of a scanning optical system using a semiconductor laser instead of the LED head 13.

The developing unit 2 uses a two-component developer including toner and a carrier, and is provided with a developing sleeve 21 arranged so as to face the photoreceptor drum 11. The developer agitated by the paddle 3 is supplied to the developing sleeve 21, and the developer held on the surface of the developing sleeve 21 is supplied to the photoreceptor drum 11. By developing the electrostatic latent image on the surface of the photoreceptor drum 11 with toner, a toner image is formed.

The transfer roller 14, which is preferably formed of EPDM foam, is in pressing contact with the photoreceptor drum 11 at a position opposing the carrier path 104, and is applied with a bias voltage from an electric circuit, not shown. A printing paper supplied from the paper feed cassette 102 via the carrier path 104 is nipped by the photoreceptor drum 11 and the transfer roller 14 and a bias voltage is applied thereon, so that the toner image formed on the surface of the photoreceptor drum 11 is transferred to the printing paper.

The cleaning blade 15 is brought into pressing contact with the photoreceptor drum 11 downstream of the transferring nip, and a constant voltage is applied thereto from an electric circuit, not shown, whereby toner or paper powder remaining on the surface of the photoreceptor drum 11 is removed, and the electrostatic latent image is erased. Consequently, the surface of the photoreceptor drum 11 is cleaned for enabling continuous usage. A cleaning method using other contact systems or non-contact systems using a cleaning roller or the like instead of the cleaning blade can also be used, and a cleaningless system having no cleaning member is also applicable.

The fixing device 16 includes a heating roller 17 and a pressure roller 18 arranged in the carrier path 104 at opposed positions, respectively, and heats and presses the toner image on the printing paper carried through the carrier path 104 to fix the same. The surface of the heating roller 17 is maintained at a predetermined temperature by a heater, and the pressure roller 18 is in a pressing contact with the heating roller 17 at a predetermined pressure. The printing paper on which the toner image is transferred is nipped between the heating roller 17 and the pressure roller 18 so that the toner on the printing paper is melted and fixed. The image on the original document read by the image reading unit is formed on the printing paper by the image forming unit 101 configured as described thus far.

Subsequently, the configuration of the developing unit 2 will be described in detail. The developing unit 2 includes the paddle 3, the developing sleeve 21, a developer container 22 for storing the developer, a regulating blade 23, and two screws (carrier augers) 24, 25 for transferring the developer stored in the developer container 22 to the paddle 3 side while agitating the same. The developing unit 2 uses the two-component developer including toner and a carrier.

The developing sleeve 21 is supported at both ends thereof by side walls, not shown, of the developer container 22 so as to be capable of rotating at a position in the proximity of the photoreceptor drum 11, and has a length at least longer than a length of the photoreceptor drum 11, that is, the maximum width of the printing paper on which the image is to be printed. The developer sleeve 21 is electrically charged on the surface thereof by being applied with a bias voltage from the electric circuit, not shown. By the supply of the developer charged by agitating, the developer is held on the surface of the developing sleeve 21. When the developing sleeve 21 is rotated about an axis in the direction indicated by an arrow (clockwise) by a driving source, not shown, synchronously with the rotation of the photoreceptor drum 11 in the direction indicated by an arrow (counterclockwise), the developer held on the surface of the developing sleeve 21 is supplied to the photoreceptor drum 11 by the difference in potential between the photoreceptor drum 11 and the electrostatic latent image. Hence, the electrostatic latent image on the surface of the photoreceptor drum 11 is converted into a viewable image, whereby a toner image is formed.

The regulating blade 23 is disposed in the developer container 22 at a position in the proximity of the surface of the developing sleeve 21 for scraping off excessive developer held on the surface of the developing sleeve 21 to regulate the thickness of the layer of the developer to be constant.

Figure 2:
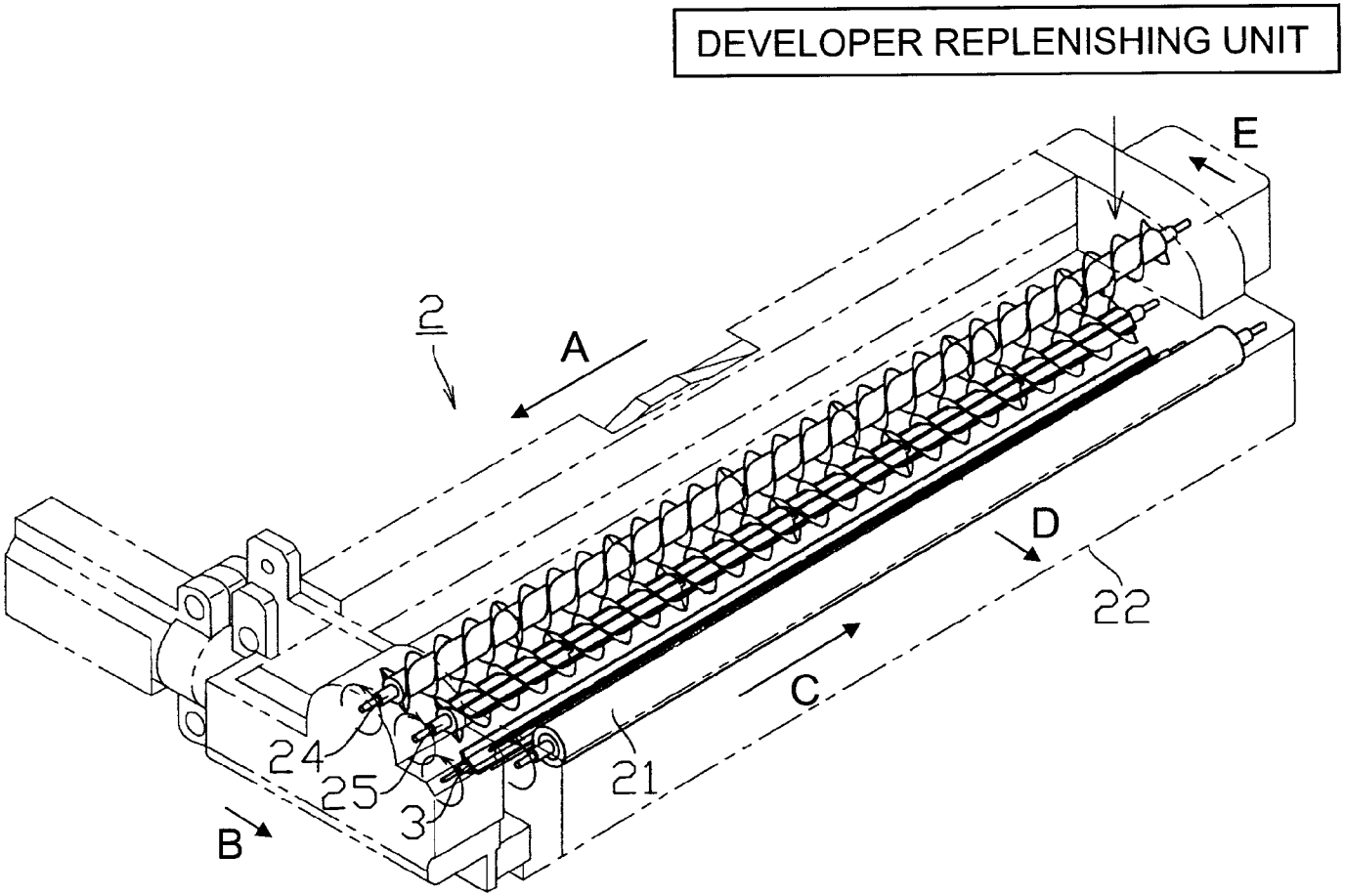
FIG. 2 is a cut-away schematic perspective view for explaining the internal structure of a developing machine unit.
Figure 3:
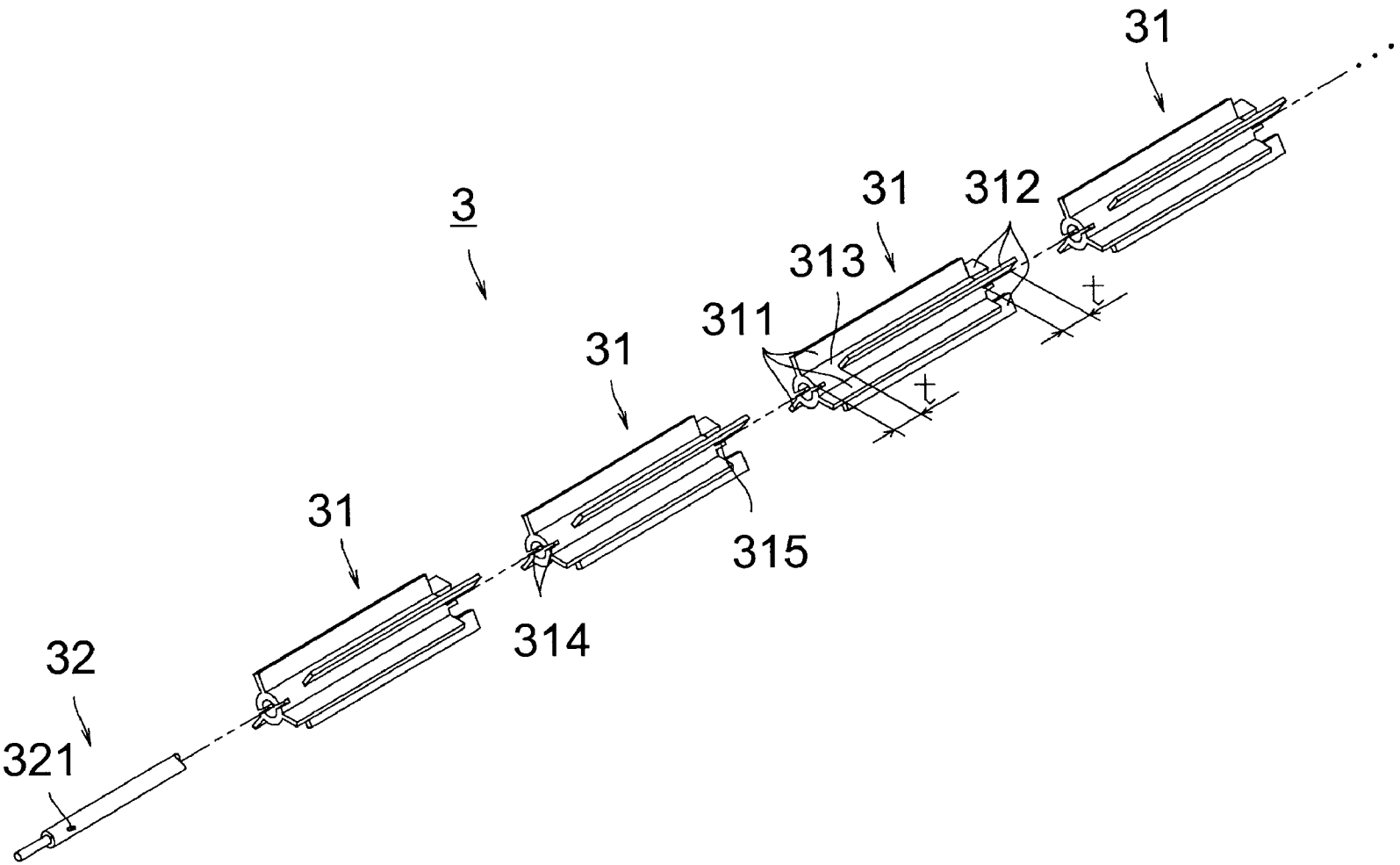
FIG. 3 is an exploded partial perspective view showing a configuration of a paddle.
Figure 4:
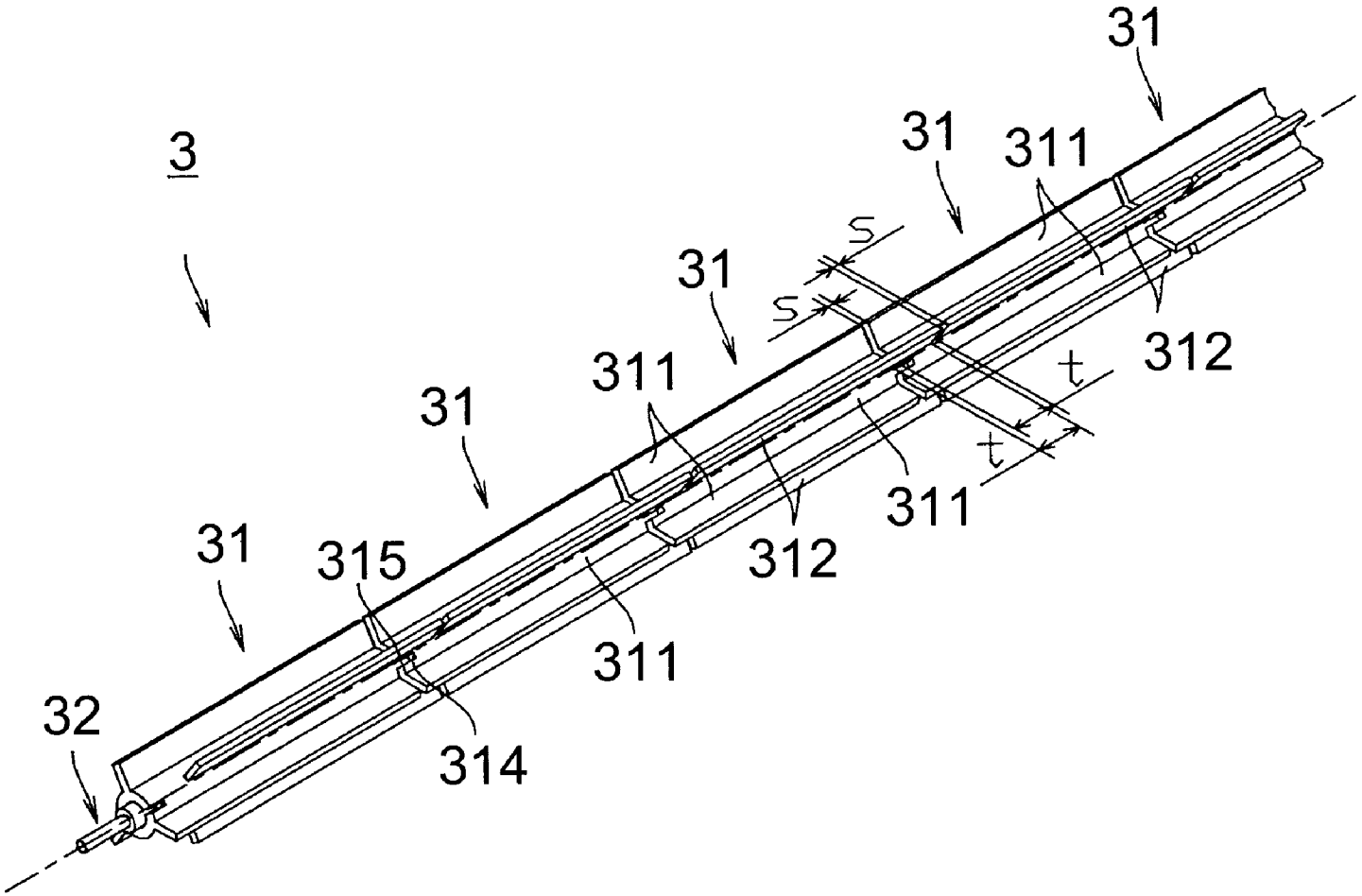
FIG. 4 is a partial perspective view showing the paddle.
Figures 5A, 5B, 5C:
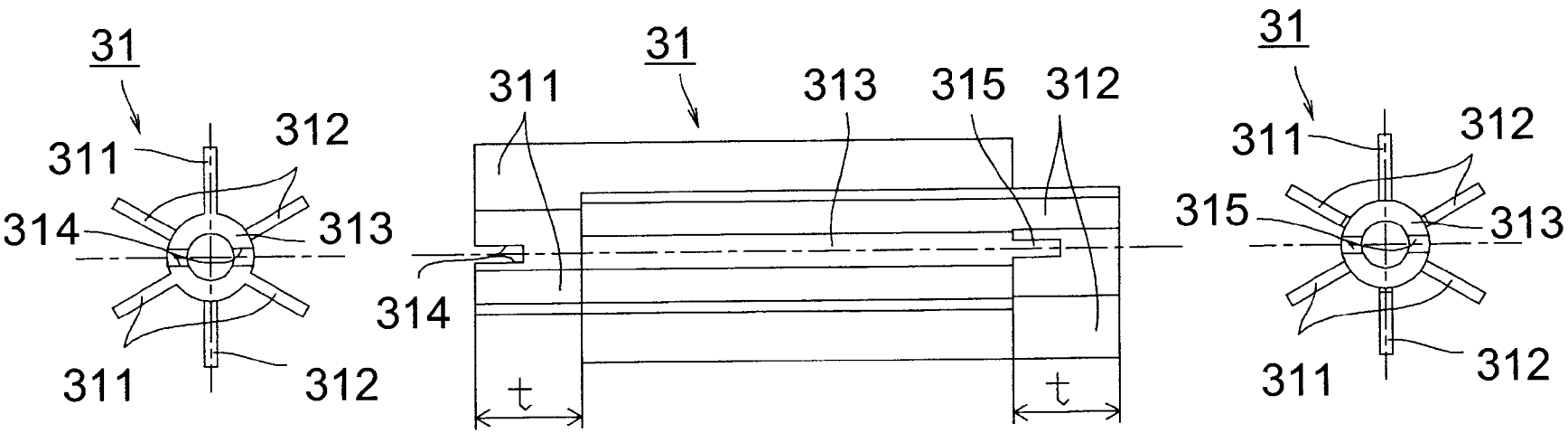
FIGS. 5A to 5C illustrate components of the paddle.
Figure 6:
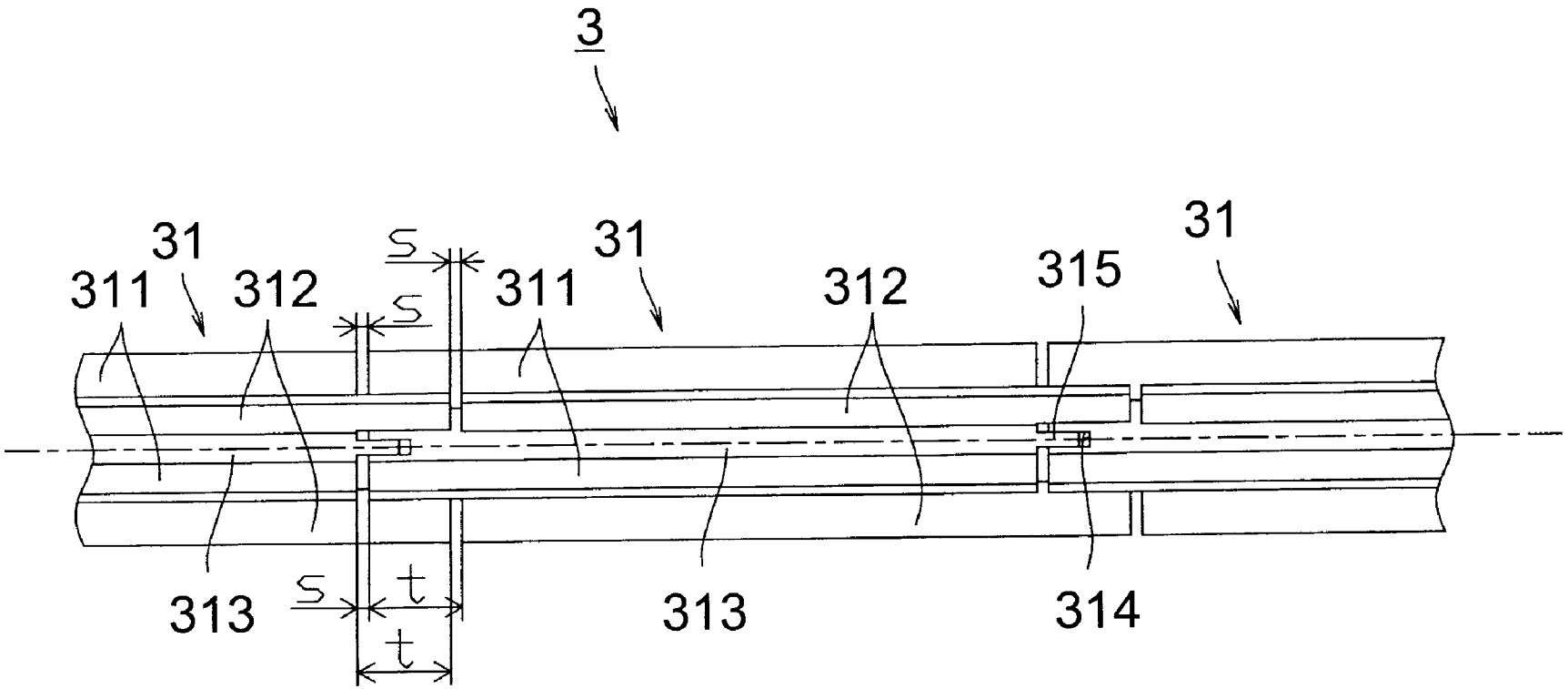
FIG. 6 is a partial front view showing the paddle.
Figure 7:
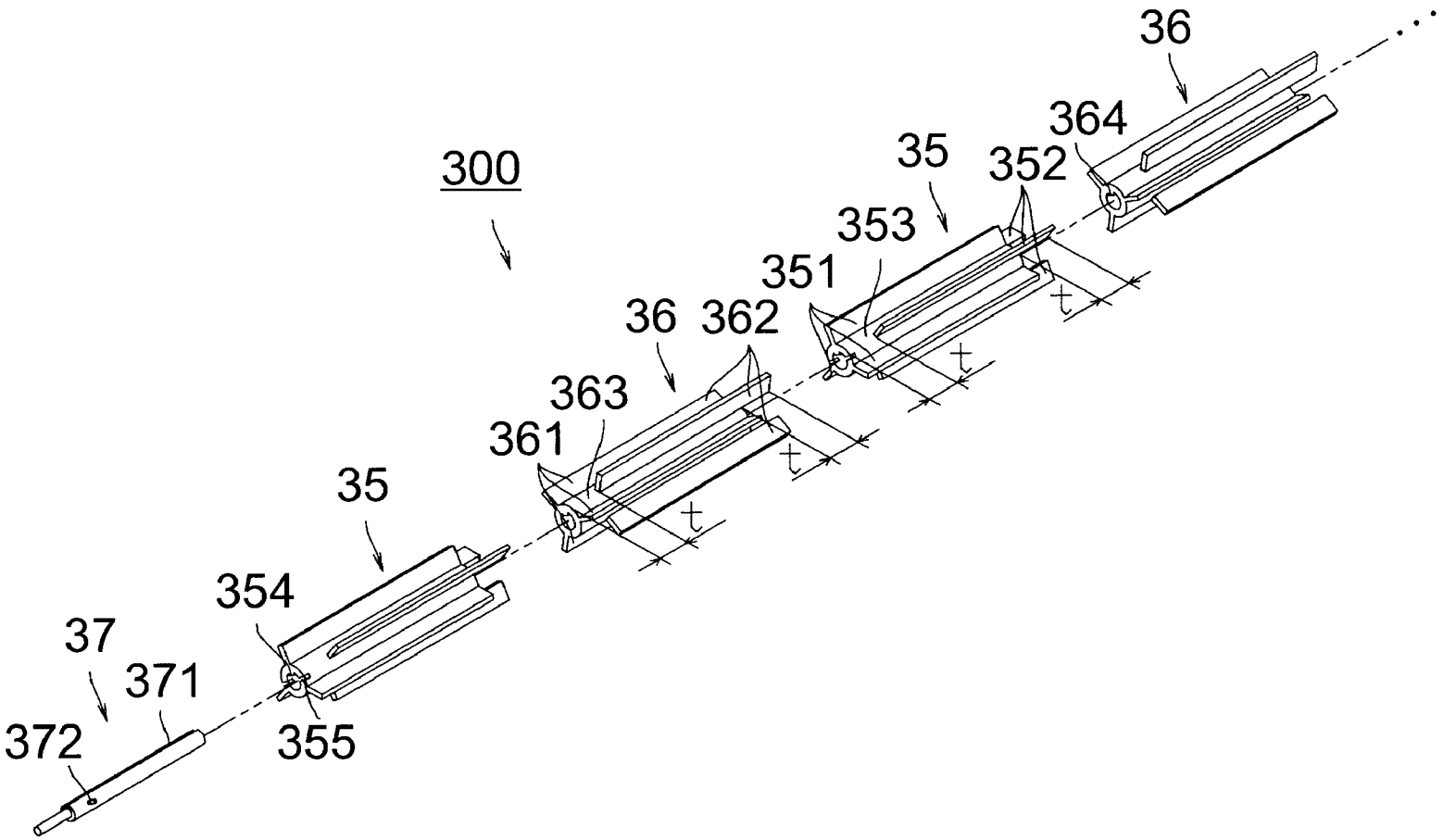
FIG. 7 is an exploded partial perspective view showing a configuration of the paddle according to another preferred embodiment of the present invention.
Figure 8:
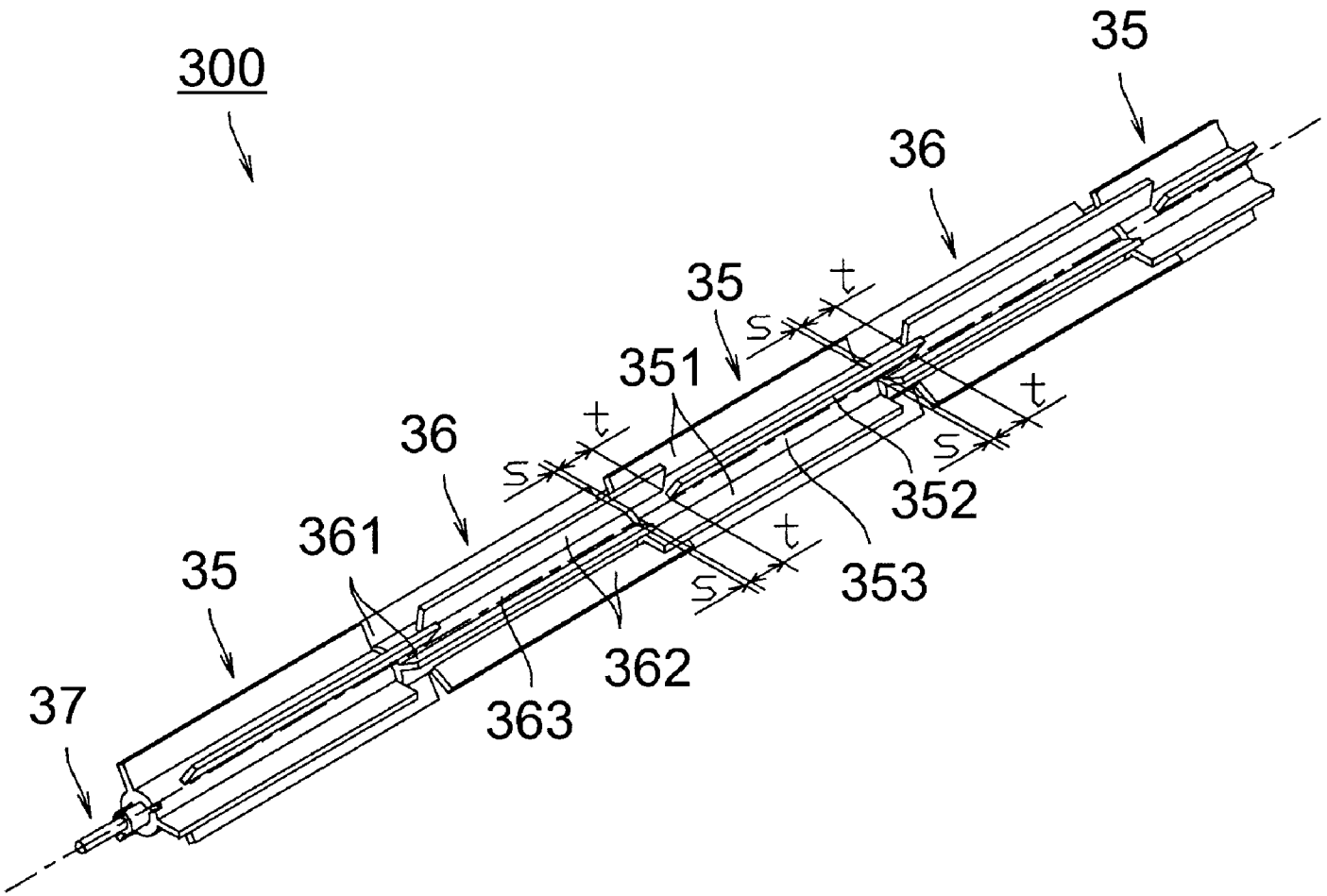
FIG. 8 is partial perspective view showing the paddle according to another preferred embodiment of the present invention.
Figures 9A, 9B, 9C, 9D, 9E, 9F:
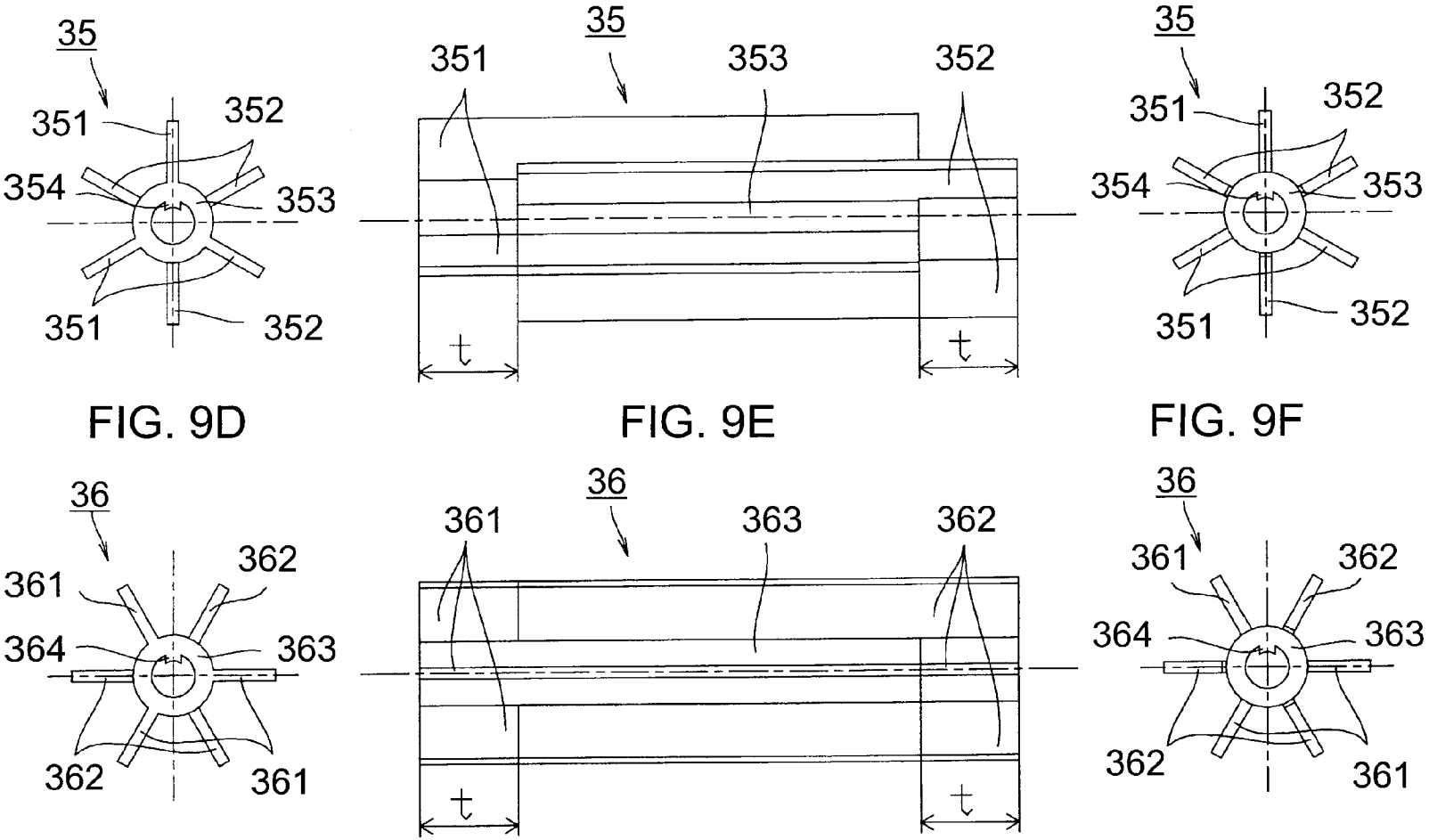
FIGS. 9A to 9F illustrate components of another preferred embodiment of the present invention.
Figure 10:
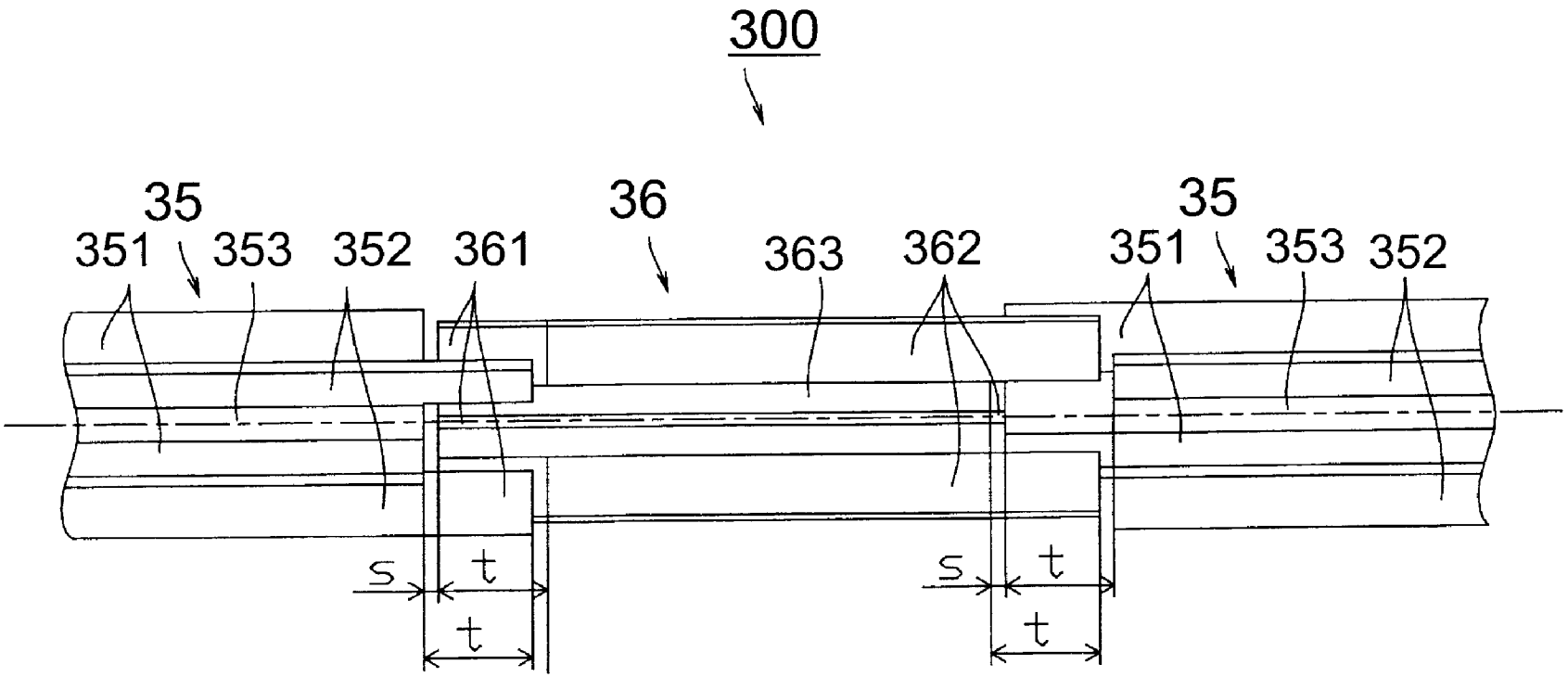
FIG. 10 is a partial front view showing the paddle according to another preferred embodiment of the present invention.
Figure 11:
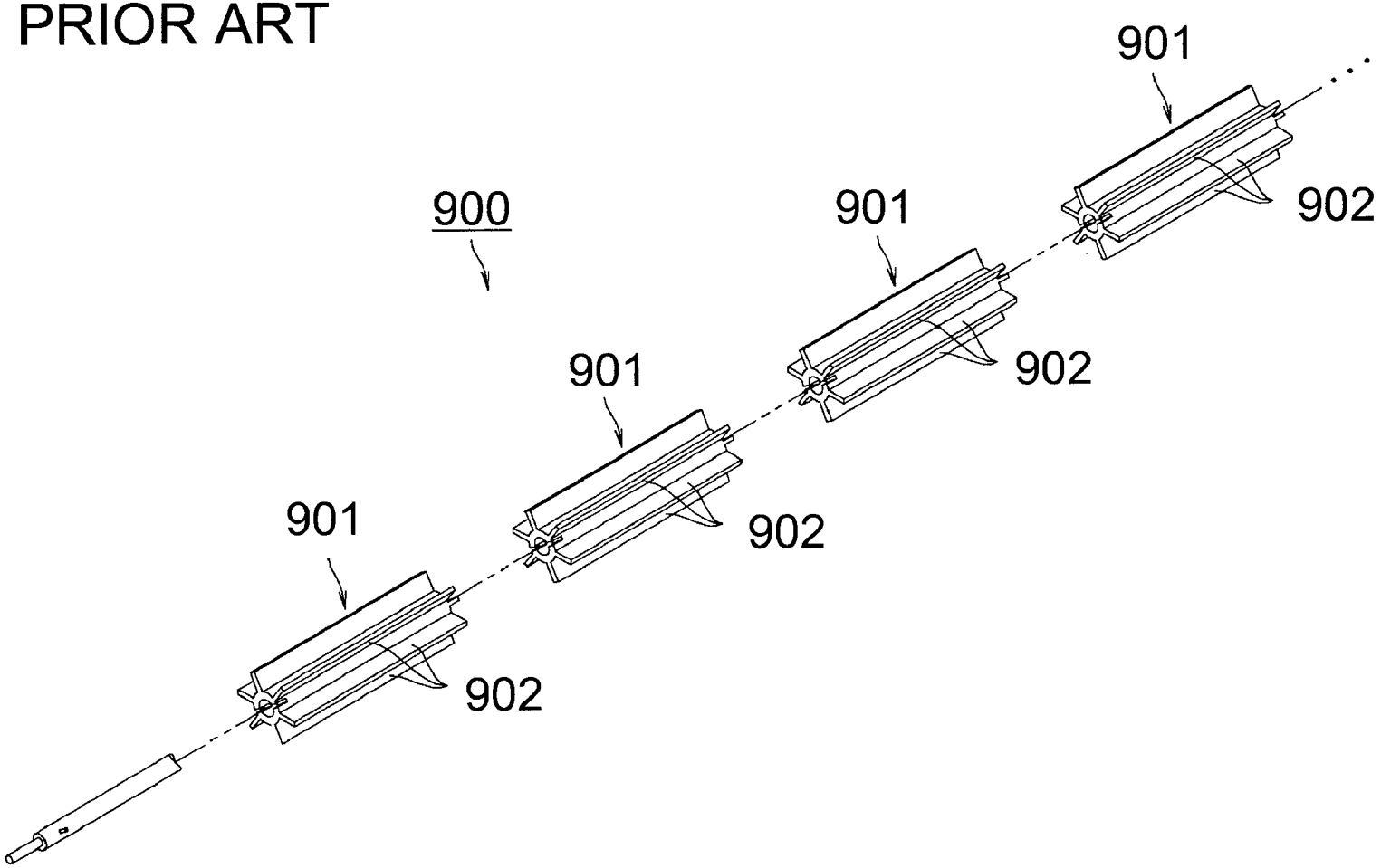
FIG. 11 PRIOR ART
FIG. 11 is an exploded partial perspective view showing a configuration of a paddle in the related art.
Figure 12:
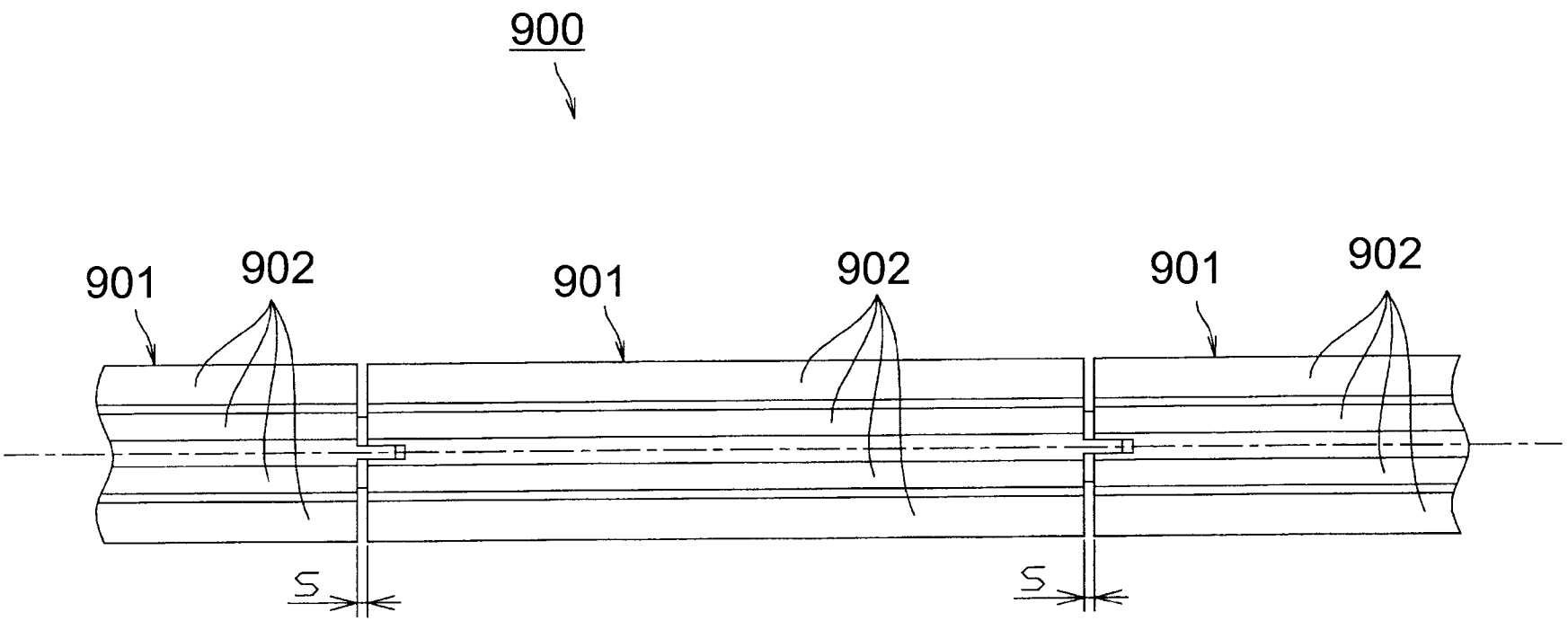
FIG. 12 PRIOR ART
FIG. 12 is a partial front view showing the paddle in the related art.

The paddle 3 is supported at both ends thereof by the side walls, not shown, of the developer container 22 so as to be capable of rotating at a position in proximity of the developing sleeve 21 in parallel with the axial line of the developing sleeve 21 as shown in FIG. 1 and FIG. 2. The paddle 3 preferably has a length equivalent to the length of the developing sleeve 21. The paddle 3 includes thin blades extending in the radial direction, and supplies the developer to the developing sleeve 21 while agitating the same by being rotated in the direction indicated by an arrow (counterclockwise) by the driving source, not shown.

As shown in FIG. 1, the bottom surface of the developer container 22 preferably has an shape in cross-section which extends along the trajectory of the rotational movement of the blades provided on the paddle 3, so that the developer is stored. The developer stored therein is agitated by the rotation of the paddle 3 and is supplied to the developing sleeve 21 by being scooped and placed thereon. The developer supplied to the developing sleeve 21 is charged by being agitated, and is held on the surface of the developing sleeve 21 which is charged with an opposite potential.

The two screws 24, 25 include a first screw 24 and a second screw 25 as shown in FIG. 1 and FIG. 2, and are supported at both ends thereof by the side walls, not shown, of the developer container 22 so as to be capable of rotating at positions side-by-side in parallel to the axial line of the paddle 3. The second screw 25 has a length equivalent to the length of the paddle 3. The first screw 24 is longer than the second screw 25 and has an extension on the right end thereof, as shown in FIG. 2. The first screw 24 includes a helical thin blade (fin) and transfers the developer while agitating the same in the direction indicated by an arrow A by being rotated in the direction indicated by an arrow (counterclockwise) by the drive source, not shown. The second screw 25 is provided with a helical thin blade and thin blades extending in the radial direction, so as to transfer the developer while agitating the same in the direction indicated by an arrow C by being rotated in the direction indicated by an arrow (clockwise) by the drive source, not shown, and transfers a portion of the developer in the direction indicated by an arrow D to the paddle 3.

The bottom surface of the developer container 22 preferably has an arcuate shape in cross section so as to extend along the trajectory of the rotational movement of the blades provided on the respective screws 24, 25 as shown in FIG. 1. Between the first screw 24 and the second screw 25, a partitioning wall 26 is provided on the bottom surface of the developer container 22 along the axial direction of the developer container 22. The partitioning wall 26 is preferably provided with communication ports, not shown, at both ends in the longitudinal direction thereof. Between the second screw 25 and the paddle 3, a partitioning wall 27 is provided on the bottom surface of the developer container 22 along the axial direction of the developer container 22. Furthermore, the partitioning wall 27 is lower than the partitioning wall 26.

When the first screw 24 is rotated, as shown in FIG. 2, the developer replenished from one end (right inner end in the drawing) of the axial direction (longitudinal direction) by a developer replenishing unit is transferred in the direction indicated by the arrow A while being agitated. The developer transferred to the other end (the left front end in the drawing) in the axial direction by the first screw 24 passes through the communication ports and is transferred in the direction indicated by an arrow B, and is further transferred in the direction indicated by the arrow C while being agitated by the rotation of the second screw 25. The developer transferred to the one end in the axial direction by the second screw 25 passes through the communication ports and is transferred in the direction indicated by an arrow E, and then transferred again by the first screw 24. In this manner, the developer is circulated and agitated sufficiently by the two screws 24, 25 which transfer the same in the opposite direction and on the opposite side of the partitioning wall 26. The developer is then transferred in the direction indicated by the arrow C by the rotation of the second screw 25, and is partly supplied to the paddle 3 beyond the partitioning wall 27 as indicated by the arrow D.

As shown in FIG. 3 to FIG. 6, the paddle 3 is configured such that a plurality of components 31 divided in the axial direction into the same shape is passed over a metallic revolving shaft 32, which is rotatably supported at both ends thereof by the developer container 22 (see FIG. 1), and are connected to each other. The respective components 31 are preferably formed of resin or plastic, and are formed integrally by injection molding or the like. The components 31 are provided with thin blades 311, 312 extending in the radial direction, and the blades 311, 312 project integrally from the surface of a cylinder 313 having a hole penetrating therethrough in the axial direction for inserting the revolving shaft 32.

The components 31 preferably include a total of six blades 311, 312 projecting in six radial directions from the center axis of the cylinder 313. The respective blades 311, 312 extend straight along the axial direction of the components 31, and an axial length of the blade is the same as an axial length of the component 31. The blades 311 are formed so that both end surfaces thereof are flush with both end surfaces of the cylinder 313 in the axial direction. On the other hand, the blades 312 are formed such that both end surfaces thereof are shifted from the end surfaces in the axial direction of the cylinder 313 by a predetermined distance t in one axial direction. In other words, the blades 312 are arranged so as to extend from positions set back in the axial direction from one end surface of the cylinder 313 by a distance t to positions projecting from the other end surface of the cylinder 313 in the axial direction by a distance t. The blades 311 and the blades 312 are arranged alternately in the circumferential direction, and the blades 311, 312 arranged on the component 31 adjacent to each other in the circumferential direction are axially shifted.

One end portion of the cylinder 313 has a recess 314 formed so as to be depressed in the axial direction and the other end of the cylinder 313 is formed with a projection 315 projecting correspondingly into the recessed portion 314. The component 31 is connected to the adjacent component 31 by fitting the recess 314 on the projection 315 of the adjacent component 31, and the relative rotation between these components 31 is restricted.

One end of the component 31 in the axial direction (the left near end in FIG. 3) is positionally restricted by inserting a pin 321 fixed to the revolving shaft 32 into the recess 314 of the component 31 positioned on the one end, and the connected component 31 is rotated in association with the rotation of the revolving shaft 32. Although not shown in the drawing, the component 31 located at the other end in the axial direction is prevented from being disconnected and is positionally restricted by a retaining plate fitted to a groove of the revolving shaft 32. The plurality of components 31 connected in this manner are positionally restricted at both ends in the axial direction by the pin 321 and the retaining plate.

In view of the limit of dimensional accuracy in injection molding or the like and assembly thereof, a space s is generated between the cylinders 313 of the connected components 31. The blades 311 of each component 31 are positioned so as to continue from the blades 311 of the component 31 connected thereto, and the space s is also generated between these blades 311 as in the case of the cylinders 313. Although the blades 312 of each component 31 are positioned so as to extend beyond the end surface of the component 31 connected thereto and continue to the blades 312 of the connected component 31, the space s is also generated between these blades 312 as in the case of the cylinders 313. However, since the blades 311 and the blades 312 are shifted in the axial direction, the space s between the adjacent blades 311 and the space s between the adjacent blades 312 are positionally shifted in the axial direction. In this manner, when the components 31 are connected, the blades 311 and the blades 312 are positioned alternately, and hence the spaces s are positionally shifted.

When the paddle 3 is rotated, the developer is agitated and scooped by the blades 311, 312, and is supplied to the developing sleeve 21. Since the space s between the blades 311 and the space s between the blades 312 are axially shifted, the developer is agitated and scooped by at least one of the blades 311 and the blades 312, and is supplied to the developing sleeve 21 along the entire axial direction. The distance t of shifting of the blades 312 from the end surfaces of the cylinder 313 maybe determined so as to exceed the maximum value of the space s which is assumed when considering the dimensional accuracy or the like of the component 31. Since the blades 311, 312 provided on the component 31 are arranged to be overlapped in the circumferential direction with the blades 311, 312 provided on the component 31 adjacent to the component 31, the substantial space is eliminated during rotation, and hence the developer can be supplied in the entire axial direction of the developing sleeve 21. The blades 312 projecting from the cylinder 313 are formed with a notch for preventing interference with the adjacent cylinder 313. However, it is also possible to form a notch or the like on the cylinder 313 for preventing interference with the blades 312.

The present invention is not limited to the preferred embodiments described above, and various modifications can be made within the scope of the present invention. For example, although an example in which the blades 311, 312 provided on the adjacent components 31 are preferably continuously positioned adjacently to each other is shown, a paddle 300 in which the blades provided on the adjacent components are not continuously positioned may be used. The paddle 300 in this configuration will be described with respect to FIG. 7 to FIG. 10.

The paddle 300 preferably includes two types of components 35, 36 formed by being divided in the axial direction and inserted onto a metallic revolving shaft 37, which is rotatably supported at both ends thereof by the developer container 22 (see FIG. 1), so as to be positioned alternately and adjacently. The respective components 35, 36 are preferably formed of resin or plastic, and are preferably integrally formed by injection molding or the like.

The components 35 include six thin blades 351, 352 extending in the radial direction, and these blades 351, 352 project radially in six directions from the surface of a cylinder 353 having a hole penetrating therethrough in the axial direction for inserting the revolving shaft 37. The respective blades

351, 352 extend straight along the axial direction of the component 35, and the axial length of the blades 352 is the same as the axial length of the components 35. The blades 351 are preferably arranged so that both end surfaces thereof are flush with both end surfaces of the cylinder 353. On the other hand, the blades 352 are preferably arranged such that both end surfaces thereof are respectively shifted in one axial direction by a predetermined distance t from both end surfaces of the cylinder 353 in the axial direction. The blades 351 and the blades 352 are arranged alternately in the circumferential direction, and the circumferentially adjacent blades 351, 352 of the component 35 are positionally shifted in the axial direction.

The component 36 is provided with six thin blades 361, 362 extending in the radial direction, and these blades 361, 362 project radially in six directions from the surface of a cylinder 363 having a hole penetrating therethrough in the axial direction for inserting the revolving shaft 37. The respective blades 361, 362 extend straight along the axial direction of the component 36, and the axial length of the blades 361, 362 is the same as the axial length of the component 36. The blades 361 are preferably arranged so that both end surfaces thereof are flush with both end surfaces of the cylinder 363. On the other hand, the blades 362 are preferably arranged such that both end surfaces thereof are shifted by a predetermined distance t from both end surfaces of the cylinder 363 in the axial direction. The blades 361 and the blades 362 are preferably arranged alternately in the circumferential direction, and the circumferentially adjacent blades 361, 362 of the component 36 are positionally shifted in the axial direction. The blades 361, 362 provided on the component 36 are preferably arranged so as to be positioned between the blades 351, 352 provided on the component 35, respectively, in the circumferential direction when the components 36 are positioned adjacent to the components 35. In other words, the blades 351, 352 and the blades 361, 362 are not arranged to be positioned continuously.

The cylinders 353, 363 are preferably formed with keys 354, 364 projecting from the inner peripheral surfaces thereof toward the center axes thereof and extending in the axial direction, and the revolving shaft 37 is formed with a key groove 371 depressed from the outer surface thereof toward the center axis thereof so as to correspond to the keys 354, 364. The components 35, 36 are restricted from rotating relatively by inserting the keys 354, 364 into the key groove 371 on the revolving shaft 37, and are adapted to rotate in association with the rotation of the revolving shaft 37.

Only the component 35 located on one end in the axial direction (the left near end in FIG. 7) is preferably formed with a recess 355, and the one end of the component 35 is positionally restricted by inserting a pin 372 fixed to the revolving shaft 37 into the recess 355. Although not shown in the drawing, the component 36 located at the other end in the axial direction is prevented from being disconnected and is positionally restricted by a retaining plate fitted to the key groove 371 of the revolving shaft 37. The plurality of components 35, 36 passed over the revolving shaft 37 and located adjacently are restricted at both ends in the axial direction by the pin 372 and the retaining plate. In view of the limit of dimensional accuracy in the injection molding or the like and assembly, the space s is generated between the cylinders 353, 363 of the adjacent respective components 35, 36.

When the paddle 300 is rotated, the developer is agitated and scooped by the blades 351, 352, 361, 362, and is supplied to the developing sleeve 21. Since the blades 351, 352, 361, 362 are arranged so as to be overlapped in the circumferential direction so that at least any one of the blades 351, 352, 361, 362 is positioned over the entire paddle 300 in the circumferential direction, the space s is eliminated during rotation, and hence the developer can be supplied entirely in the axial direction of the developing sleeve 21.

In addition, although the examples in which the paddle 3, 300 is provided with the blades 311, 312 extending in the radial direction and in the axial direction are shown in the preferred embodiments, the paddle may be provided with blades of other shapes, such as an obliquely extending blade, a helical blade, and the like, and the number of blades and so on are not limited. Although the example in which two types of blades such as the blades 311, 312 are provided on the paddle 3, 300 alternately in the circumferential direction is shown in the drawings, three or more types of blades may be provided without limitation of the circumferential order. The example in which the blades 311, 312 of the paddle 3, 300 are constructed to have the same length as the axial length of the cylinder 313 is shown in the drawings, blades having a length different from the axial length of the cylinder 313 or the like or blades having different lengths from each other may be provided.

In addition, although an image forming apparatus having the developing unit 2 in which the two-component developer transferred by the two screws 24, 25 is supplied to the paddle 3 side has been described in the preferred embodiments above, the developing unit 2 in this configuration is illustrative only. For example, although a developing unit 2 having two screws 24, 25 is shown, the number of the screws is not limited to two, and other structures that supply the developer to the paddle 3 such as a bucket or a pump instead of the screws 24, 25 may also be used. Although a developing unit 2 to which two-component developer is replenished is shown, it may be a unit to which only the toner is replenished, or a unit to which the toner and the carrier are replenished separately, or a unit using a one-component developer.

In addition, in the preferred embodiments above, a mode in which an image forming apparatus is implemented as a copy/facsimile multi-function machine 100 has been described, the image forming apparatus is not limited to the copy/facsimile multi-function machine 100, and the may be modified without departing from the scope of the present invention, such as an independent machine or a printer.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the present invention.

What is claimed is:

1. A paddle comprising:

a plurality of axially divided components, each component including axially extending blades, wherein the blades of a first component overlap in a circumferential direction with blades provided on an adjacent component.

2. The paddle according to claim 1, wherein the blades of the first component extend in a radial direction, and the blades of the adjacent component are axially shifted in the circumferential direction.

3. The paddle according to claim 1, wherein the blades provided on the first component and the blades provided on the adjacent component are continuous.

4. The paddle according to claim 1, wherein the blades of the first component extend in a radial direction, and the blades of the adjacent component are axially shifted in the circumferential direction, and wherein the blades provided on the first component and the blades provided on the adjacent component are continuous.

5. The paddle according to claim 1, wherein the first component and the adjacent component have the same shape.

6. The paddle according to claim 1, wherein the blades of the first component extend in a radial direction, and the blades of the adjacent component are axially shifted in the circumferential direction, and wherein the first component and the adjacent component have the same shape.

7. The paddle according to claim 1, wherein the blades provided on the first component and the blades provided on the adjacent component are continuous, and wherein the first component and the adjacent component have the same shape.

8. The paddle according to claim 1, wherein the blades of the first component extend in a radial direction, and the blades of the adjacent component are axially shifted in the circumferential direction, the blades provided on the first component and the blades provided on the adjacent component are continuous, and the first component and the adjacent component have the same shape.

9. A developing device comprising:

a developing sleeve arranged to supply developer to a photoreceptor;

a developer container arranged to store the developer; and a paddle rotatably supported by the developer container and arranged to supply the developer stored in the developer container to the developing sleeve while agitating the same; wherein the paddle includes a plurality of axially divided components, each component includes axially extending blades, and the blades provided on a first component overlap in a circumferential direction with blades provided on an adjacent component.

10. The developing device according to claim 9, wherein the blades of the first component extend in a radial direction, and the blades of the adjacent component are axially shifted in the circumferential direction.

11. The developing device according to claim 9, wherein the blades provided on the first component and the blades provided on the adjacent component are continuous.

12. The developing device according to claim 9, wherein the blades of the first component extend in a radial direction, and the blades of the adjacent component are axially shifted in the circumferential direction, and wherein the blades provided on the first component and the blades provided on the adjacent component are continuous.

13. The developing device according to claim 9, wherein the first component and the adjacent component have the same shape.

14. The developing device according to claim 9, wherein the blades of the first component extend in a radial direction, and the blades of the adjacent component are axially shifted in the circumferential direction, and wherein the first component and the adjacent component have the same shape.

15. The developing device according to claim 9, wherein the blades provided on the first component and the blades provided on the adjacent component are continuous, and wherein the first component and the adjacent component have the same shape.

16. The developing device according to claim 9, wherein the blades of the first component extend in a radial direction, and the blades of the adjacent component are axially shifted in the circumferential direction, the blades provided on the first component and the blades provided on the adjacent component are continuous, and the first component and the adjacent component have the same shape.

17. An image forming apparatus comprising:

a photoreceptor;

a developing sleeve arranged to supply developer to the photoreceptor;

a developer container arranged to store the developer; and a paddle that is rotatably supported by the developer container and arranged to supply the developer stored in the developer container to the developing sleeve while agitating the same; wherein the paddle includes a plurality of axially divided components, each component includes axially extending blades, and the blades provided on a first component overlap in a circumferential direction with blades provided on an adjacent component.

18. The image forming apparatus according to claim 17, wherein the blades of the first component extend in a radial direction, and the blades of the adjacent component are axially shifted in the circumferential direction.

19. The image forming apparatus according to claim 17, wherein the blades provided on the first component and the blades provided on the adjacent component are continuous.

20. The image forming apparatus according to claim 17, wherein the blades of the first component extend in a radial direction, and the blades of the adjacent component are axially shifted in the circumferential direction, and wherein the blades provided on the first component and the blades provided on the adjacent component are continuous.

21. The image forming apparatus according to claim 17, wherein the first component and the adjacent component have the same shape.

22. The image forming apparatus according to claim 17, wherein the blades of the first component extend in a radial direction, and the blades of the adjacent component are axially shifted in the circumferential direction, and wherein the first component and the adjacent component have the same shape.

23. The image forming apparatus according to claim 17, wherein the blades provided on the first component and the blades provided on the adjacent component are continuous, and wherein the first component and the adjacent component have the same shape.

24. The image forming apparatus according to claim 17, wherein the blades of the first component extend in a radial direction, and the blades of the adjacent component are axially shifted in the circumferential direction, the blades provided on the first component and the blades provided on the adjacent component are continuous, and the first component and the adjacent component have the same shape.

* * * * *

UNITED STATES PATENT AND TRADEMARK OFFICE

CERTIFICATE OF CORRECTION

PATENT NO. : 7,653,333 B2
APPLICATION NO. : 11/620863
DATED : January 26, 2010
INVENTOR(S) : Hideaki Kawai It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 520 days.

Signed and Sealed this

Twenty-third Day of November, 2010

David J. Kappos

David J. Kappos
*Director of the United States Patent and Trademark Office*